United States Patent [19]

Makovic et al.

[11] 4,443,012

[45] Apr. 17, 1984

[54] COMBINATION CARD AND DICE GAME

[76] Inventors: Edward M. Makovic; Dorothy I. Makovic, both of 510 N. Lincoln, Coal City, Ill. 60416

[21] Appl. No.: 239,842

[22] Filed: Mar. 2, 1981

[51] Int. Cl.[3] ..... A63F 1/04

[52] U.S. Cl. ..... 273/292; 273/268

[58] Field of Search ..... 273/146, 292, 303, 268

[56] References Cited

U.S. PATENT DOCUMENTS

| | | | |
|---|---|---|---|
| D. 59,761 | 11/1921 | McCarthy | 273/292 X |
| 645,961 | 3/1900 | Kingwill | 273/303 |
| 689,292 | 12/1901 | Graham | 273/292 X |
| 2,560,187 | 7/1951 | Post | 273/303 X |
| 3,652,086 | 3/1972 | Stecker | 273/292 |

*Primary Examiner*—Anton O. Oechsle

[57] ABSTRACT

A combination card and dice game, comprising a quantity of chips, a deck of cards and a pair of dice, the deck of cards comprising a plurality of cards of like kind or suits, and a plurality of different suits, the number of suits corresponding to the possible combinations of numbers which can be rolled by an ordinary pair of game dice except for the number seven, each plurality of suits having for example six identical cards, the deck of cards thus comprising six cards corresponding to the number two (the lowest combination of numbers possible with a pair of dice), six cards corresponding to the number three, six corresponding to the number four, six corresponding to the number five, six corresponding to the number six, six corresponding to the number eight and so on through the number twelve (the highest combination of numbers possible with a pair of dice). The cards are dealt to players who turn down cards corresponding to each roll of dice, the player who first turns down all of his cards being the winner. When a player rolls a seven with the dice, play passes to the next player to his left. If a player rolls a number with the dice for which he does not have a corresponding card, play passes to the first player on his left who does have such a corresponding card. After each turn, the players place a chip into the pot which at the end of the game goes to the winner, the first to turn over all of his cards.

4 Claims, 3 Drawing Figures

COMBINATION CARD AND DICE GAME

BACKGROUND OF THE INVENTION

This invention relates to the field of card games in which a pair of game dice are used.

There are of course numerous card games, and many games which include the use of one or more dice, but the one described and claimed herein is believed to be unique. The cards are divided into suits which correspond to the combinations of numbers which can be rolled by a pair of ordinary game dice, being small cubes having six sides, each side having a number of dots from one to six, so the combinations of numbers possible are two through twelve. However, the deck of cards in accordance with this game does not include a suit which corresponds with the number seven. When a roll of dice turns up the number seven, there are no corresponding cards to play and the play then passes to the next player.

To further distinguish from known card and dice games, while adding yet another familiar game feature, the cards may be designed as dominoes. Those corresponding to the number two may include the feature of one or more dominoes, comprising a rectangular object divided in half to comprise two adjacent squares, each adjacent square including one dot, so both squares together each having one dot add up to the number two. Those cards corresponding to the number three may include one or more dominoes, each having a total of three dots, and so on for each suit of cards up through the number twelve except for the number seven. The numbers "2," "3," "4," "5," "6," "8," "9," "10," "11," and "12" may also appear on the respective suits of cards.

SUMMARY OF THE INVENTION

It is an object of the invention to provide a combination card and dice game in which the cards correspond to the numbers rolled by each throw of the dice.

It is an object of the invention to provide a combination card and dice game, having a deck of cards having a plurality of suits, each suit corresponding to one of the number combinations which can be rolled by a throw of the dice.

It is an object of the invention to provide a combination card and dice game, having a deck of cards and a pair of dice, the deck of cards including the features of dominoes having a plurality of dots thereon, the number of dots on each respective domino corresponding to one of the number combination which can be rolled by a throw of the dice.

DESCRIPTION OF PREFERRED EMBODIMENT

A combination card and dice game comprising a deck of cards 1, divided into ten separate suits designated respectively by the reference numbers 2, 3, 4, 5, 6, 8, 9, 10, 11 and 12 which correspond with the names of the suits themselves.

Figure 1:
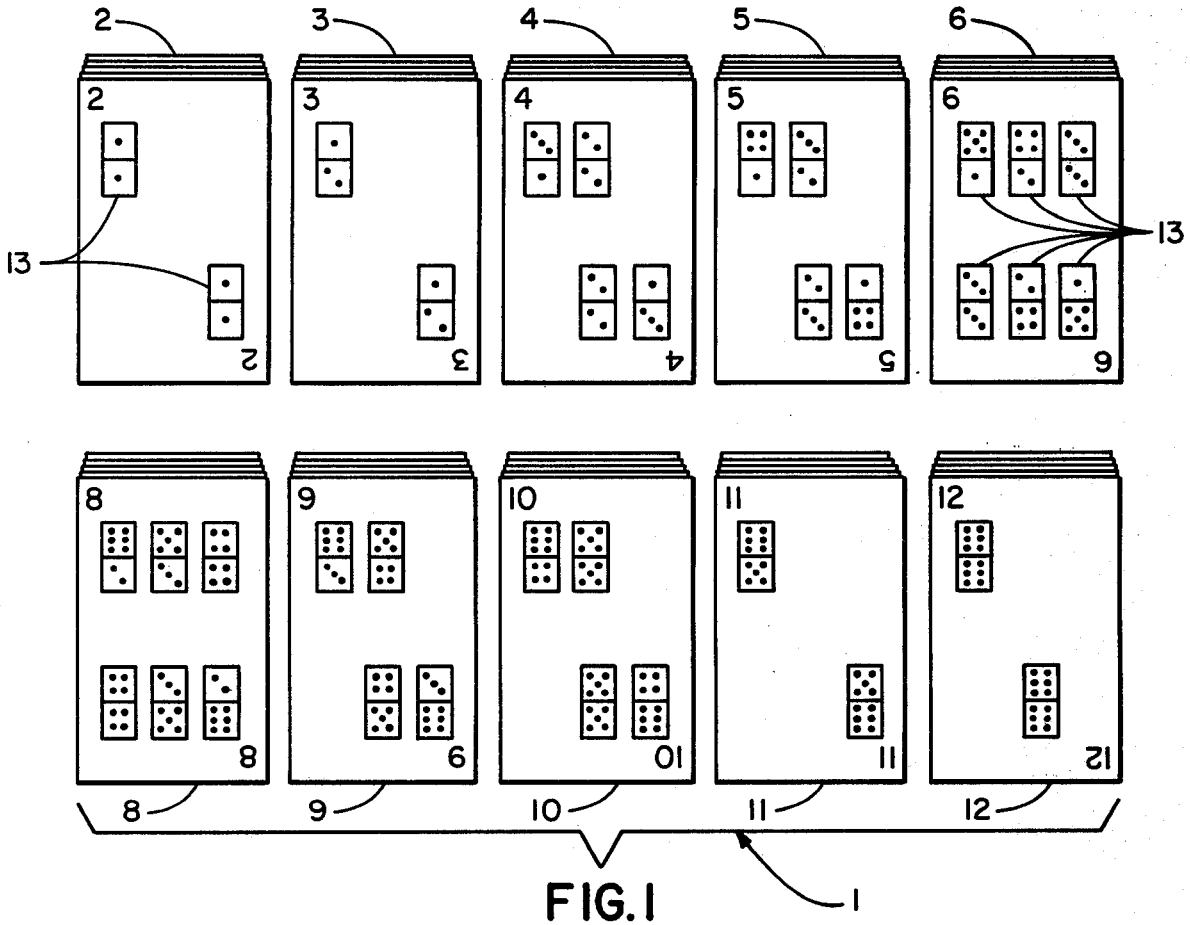
FIG. 1 is a plan view of a deck of cards in accordance with this invention, shown separated into ten different suits.

Each suit includes a plurality of identical cards, such as six cards for example in suit 2 each having the number "2" thereon in two diagonally opposite corners, six cards in suit 3 each having the number "3" thereon in two diagonally opposite corners, and so on for each suit respectively, each of the six cards in each suit having identical markings, such as shown on the top card of each suit in FIG. 1.

In addition to the numbers 2, 3, 4, 5, 6, 8, 9, 10, 11 and 12 on the cards in each suit respectively, one or more domino characters 13 may be included, each having the number of dots which corresponds with the particular number of the suit of cards with which it is included. For example, for suit 2 which includes the numbers "2" in diagonally opposite corners, two domino characters 13 may be included each domino character having two dots. For cards in suit 3, the domino characters included thereon each have three dots, and so on for each suit respectively as shown in FIG. 1.

Figure 2:
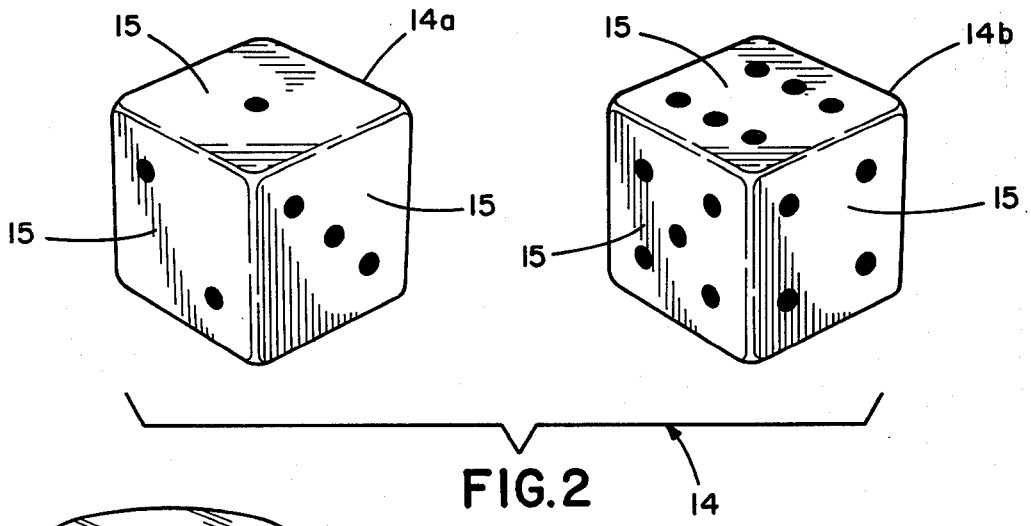
FIG. 2 is a perspective view of a pair of dice in accordance with this invention, one die in the pair showing three of the six sides each die has, the other die showing the other three sides.
Figure 3:
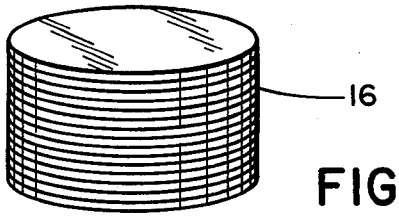
FIG. 3 is a perspective view of a stack of chips for use in playing the game in accordance with this invention.

A pair of dice **14*a* and 14*b* are provided as shown in FIG. 2, which may be ordinary game dice, each in substantially the form of a cube having six substantially square sides 15** each side having one or more dots thereon respectively from one through six dots. The possible combinations of numbers which may be obtained from rolls of the dice are two, three, four, five, six, seven, eight, nine, ten, eleven and twelve.

These possible combinations of numbers correspond with the numbers of the suits 2, 3, 4, 5, 6, 8, 9, 10, 11 and 12 in the deck of cards 1, except for the number seven. There is no suit corresponding to the number seven in the deck of cards 1 used in playing the game described herein.

A stack of one hundred chips 16 may also be provided for use as described hereinbelow. A greater or lesser number of chips may be used.

The deck of cards 1 as described herein consists of sixty cards, six in each suit 2, 3, 4, 5, 6, 8, 9, 10, 11 and 12. The number of cards dealt to each player will depend on the number of persons playing the game. All of the cards in the deck are dealt out, with each player receiving the same number, and any cards left over after dealing each player an equal number are discarded. In one version of the game, the following table may be used showing how many cards each player receives when various numbers of players are in the game and indicating which cards should be eliminated:

| Number of Players | Number of Cards Each Player Receives | Cards to be Removed From Deck |
|---|---|---|
| Eight | 7 | Two "2s" and Two "12s" |
| Seven | 8 | Two "2s" and Two "12s" |
| Six | 9 | Two "2s", Two "12s", One "11" and one "3" |
| Five | 11 | Two "2s", Two "12s" and one "11" |
| Four | 14 | Two "2s" and Two "12s" |

Before starting the game, the chips 16 are evenly divided among the players. The deck of cards 1 is shuffled, and one or more players cut the deck. Each player takes a card and the one with the highest number deals.

The cards are dealt in clockwise rotation until all cards remaining in the deck are dealt out provided this results in each player receiving the same number of cards. Any odd cards remaining are discarded.

Each player turns up his cards on the playing table, and arranges them in numerical sequence before him from left to right with the lowest number to the left, and with cards having like numbers placed one on top of the other in the same stack.

The player to the left of the dealer is the first to make a play. He rolls the pair of dice 14 and observes what number combination is rolled. If it is a two, the player examines his cards to see if he has one or more cards in suit 2, having the designation "2" thereon. If so, he turns one of such cards over, and rolls the dice again, turning over a card each time which corresponds to the number rolled. If the player does not have a card corresponding to the number combination rolled with the pair of dice, and if one or more other players do have a card corresponding to that number combination, the play passes clockwise to the left to the first player having such a card who turns such card over, and he then continues the play.

If no player has a card corresponding to the number combination rolled, the player who rolled the dice rolls again and continues play.

When the player who is rolling the dice rolls a seven, he must put a chip 16 into the pot and his turn is over. The play passes to the next player on the left. There is no suit in the deck of cards 1 which corresponds to the number seven.

The first player to turn over all of his cards wins the game and receives the chips 16 in the pot.

We claim:

1. A method of utilizing a game apparatus, including selection of a deck of cards having a plurality of cards of different suits, selection of a random selection means having identifying means corresponding to said different suits of said deck of playing cards, dealing said cards to a plurality of players, a first one of said players operating said random selection means to randomly identify one of said suits, removing a card in such identified suit in such first player's hand from further play, repeating operation of said random selection means by said first player and removing from his hand cards in suits identified by each such operation of said random selection means until said random selection means identifies a suit for which said first player does not have a card, passing the play to the nearest adjacent player who has a card in the suit identified by said random selection means as a result of its last operation, said nearest adjacent player removing such card from further play, said nearest adjacent player then operating said random selection means repeatedly and removing cards from his hand in suits identified by each such operation of said random selection means, wherein the step of selecting a deck of cards having a plurality of cards of different suits includes the step of selecting a deck wherein the plurality of different suits correspond respectively to the numbers two, three, four, five, six, eight, nine, ten, eleven and twelve, wherein the step of selecting a random selection means includes the step of selecting a pair of game dice operable to roll the number combinations two, three, four, five, six, seven, eight, nine, ten, eleven and twelve, and including the additional step of passing the play to the next adjacent player when said nearest adjacent player rolls said pair of dice and produces the number combination of seven.

2. The method of playing a card game as set forth in claim 1, including the step of selecting a plurality of chips and distributing to each player, and the step of each player putting one chip into a central pot when such player rolls a seven with said pair of dice during his turn of play.

3. The method of playing a card game as set forth in claim 2, including the steps of continually passing the play to other players when the player before rolls said pair of dice to produce the number combination of seven, each player in turn removing those cards in his hand from further play indicated by successive rolls of said dice, continuing such play until one of said players has removed all of his cards from further play, such player receiving all of said chips in said central pot and being the winner of the game.

4. The method of playing a card game as set forth in claim 1, including the steps of passing the play to the other players after said nearest adjacent player can no longer continue, each player in turn removing those cards in his hand from further play indicated by successive operations of said random selection means by him, and continuing such play until one of said players has removed all of his cards from further play, such player being the winner of the game.

* * * * *